US005417279A

United States Patent [19]

Wada

[11] Patent Number: 5,417,279

[45] Date of Patent: May 23, 1995

[54] HEAT EXCHANGER HAVING IN FINS FLOW PASSAGEWAYS CONSTITUTED BY HEAT EXCHANGE PIPES AND U-BEND PORTIONS

[75] Inventor: Kouji Wada, Fuji, Japan

[73] Assignee: Kabushiki Kaisha Toshiba, Kawasaki, Japan

[21] Appl. No.: 83,694

[22] Filed: Jun. 30, 1993

[30] Foreign Application Priority Data

Aug. 31, 1992 [JP] Japan ..... 4-232472

[51] Int. Cl.[6] ..... F28F 13/00

[52] U.S. Cl. ..... 165/122; 165/145; 165/150

[58] Field of Search ..... 165/122 I, 124, 145, 165/150

[56] References Cited

U.S. PATENT DOCUMENTS

| | | | |
|---|---|---|---|
| 4,089,368 | 5/1978 | Bell et al. | 165/150 X |
| 4,135,282 | 1/1979 | Neff et al. | 165/150 X |
| 4,434,843 | 3/1984 | Alford | 165/150 |
| 4,831,844 | 5/1989 | Kadle | 165/150 X |
| 5,174,366 | 12/1992 | Nagakura et al. . | |
| 5,211,219 | 5/1993 | Kawabata et al. | 165/122 |

FOREIGN PATENT DOCUMENTS

| | | | |
|---|---|---|---|
| 1272920 | 4/1961 | France | 165/145 |
| 2106228 | 4/1990 | Japan . | |
| 270892 | 9/1992 | Japan | 165/150 |

*Primary Examiner*—Stephen M. Hepperle

*Attorney, Agent, or Firm*—Cushman, Darby & Cushman

[57] ABSTRACT

The present invention includes fins that are juxtaposed at narrow intervals. One side of the fins serves as an upstream side, and the other side thereof serves as a downstream side. Heat exchange air passes through the fins. A bent portion is provided at a substantially middle portion of the fins in the longitudinal direction of the fins, and the fins are bent at the bent portion at a predetermined angle. Heat exchange pipes are provided to penetrate the fins and are arranged in an upstream-side front row and a downstream-side rear row. U-bend portions are provided to connect end portions of adjacent heat exchange pipes. Passageways for guiding a heat exchange medium are formed by the heat exchange pipes and U-bend portions. The passageways introduce the heat exchange medium from a flow introducing unit provided on the upstream side, guide the heat exchange medium from the upstream side to the downstream side at the bent portion, guide the heat exchange medium again to the upstream side, and discharge the heat exchange medium from a flow discharging unit provided on the downstream side.

10 Claims, 5 Drawing Sheets

HEAT EXCHANGER HAVING IN FINS FLOW PASSAGEWAYS CONSTITUTED BY HEAT EXCHANGE PIPES AND U-BEND PORTIONS

BACKGROUND OF THE INVENTION

1. Field of the Invention

The present invention relates to a heat exchanger provided in an air conditioner, wherein a number of fins are juxtaposed with narrow intervals, heat exchange pipes are provided to penetrate the fins, and end portions of the heat exchange pipes projecting sideways from the outermost ones of the fins are connected by U-bend portions, thereby forming passageways.

2. Description of the Related Art

Published Unexamined Japanese Patent Application (PUJPA) No. 2-106228, for example, discloses a method of manufacturing a bent-type heat exchanger having an upper heat exchanger unit and a lower heat exchanger unit which are bent a predetermined angle at the connection portions of the fins.

According to this manufacturing method, a number of fins, each having a notch and a hole so as to have at least two connecting portions, are arranged at regular intervals. Heat conduction pipes penetrate the fins, and the notch and hole are cut off.

The connecting portions are formed as spaces. The lower end face of the upper heat exchanger unit and the upper end face of the lower heat exchanger unit are opposed to each other such that the distance therebetween is large on the outside of the bent portion and gradually decreases towards the inside of the bent portion.

If the above bent-type heat exchanger is used within the indoor unit of an air conditioner, the space for installation of the unit body is not increased, as compared to a conventional flat vertical type heat exchanger, and the heat exchange area is increased remarkably. As a result, the heat exchange efficiency is enhanced.

However, the following drawbacks reside in the above method.

The heat exchanger is provided with a front passageway and a rear passageway on the upstream side and down stream side of guided heat exchange air. First, a refrigerant or a heat exchange medium is guided into the front passageway, and then the refrigerant is guided into the rear passageway.

In the above-mentioned connecting portions, a connection pipe is passed between the front passageway of the upper and lower heat exchanger units, and the refrigerant is guided to the heat exchanger units. On the other hand, the rear passageway is connected to a refrigerant output unit from which the refrigerant which has completed heat exchange is output.

The upstream-side distance between the connecting portions is large and the downstream-side distance is small. Thus, the heat exchange air guided to the connecting portions is not subjected to heat exchange with the upstream-side front passageways, but only with the downstream-side rear passageways.

However, the refrigerant at the rear passageways is just about to be output to the refrigerant output unit and is in the super-heat state. Therefore, the refrigerant does not perform a heat exchange function.

In particular, under the conditions of high humidity, the humidity in the heat exchange air passing in the vicinity of the connecting portions is not removed.

Consequently, humid air tends to remain in the housing of the unit, and dew condensation may occur on parts of the air blower situated within the housing and on the inside wall of the housing.

In addition, in order to pass the refrigerant more smoothly and efficiently, a three-way bend is provided midway along the passageway, thereby increasing the number of passageways and optimizing the use of the passageways.

For example, when the refrigerant is distributed by the three-way bend unit in the vicinity of a refrigerant input unit in the cooling mode, the distributed refrigerant is in the liquid phase. Thus, even if the refrigerant is distributed in any manner, it is distributed substantially equally into two mutually perpendicular directions, and no problem will occur.

However, there is a case of using a three-way bend unit on the downstream side of the middle portion of the passageway, which takes in the refrigerant from a side port and distributes it in upward and downward directions.

In the vicinity of the middle portion of the passageway, a heat exchange function is performed and the ratio of gas-phase refrigerant to liquid-phase refrigerant increases. Consequently, a great amount of gas-phase refrigerant flows upwards and only a small amount of liquid-phase refrigerant flows downwards.

As a result, the amount of circulated refrigerant decreases, and the heat exchange efficiency is degraded.

Furthermore, the diameter of each heat exchange pipe used in the heat exchanger is very small (e.g. 6.35 m/mϕ).

In the heating mode, the heat exchanger of the indoor unit functions as a higher-pressure side heat exchanger, and the flow rate of the refrigerant increases. Thus, the heat exchange efficiency is enhanced.

However, in the cooling mode, this heat exchanger functions as a lower-pressure side heat exchanger. Thus, a pressure loss of refrigerant due to pipe friction increases considerably and the cooling performance decreases.

In order to compensate the decrease in cooling performance, it can be thought to branch the passageway in front of the heat exchanger and decrease the pressure loss in the heat exchanger. However, it is difficult to uniformly supply the refrigerant to the branched passageways, and the heat exchange efficiency deteriorates due to the non-uniform flow rate.

SUMMARY OF THE INVENTION

The object of the present invention is to provide a heat exchanger wherein humidity of heat exchange air is surely removed under high-humidity conditions, dew condensation on peripheral parts is prevented, uniform branch flow passage is ensured even if a composition of a heat exchange medium varies due to a heat exchange action midway along the passageway, and the heat exchange medium is supplied uniformly through the entire passages with a greater amount of circulated heat exchange medium and higher heat exchange efficiency.

According to this invention, there is provided a heat exchanger having in fins flow passageways constituted by heat exchange pipes and U-bend portions, comprising:

fins juxtaposed at narrow intervals, one side of the fins serving as an upstream side for receiving heat exchange air, the other side of the fins serving as a downstream side for outputting the heat exchange air;

a bent portion provided at a substantially middle portion of the fins in the longitudinal direction of the fins, the fins being bent at the bent portion in the direction of conduction of the heat exchange air;

passageways constituted by heat exchange pipes and U-bend portions, the heat exchange pipes being arranged in an upstream-side front row and a downstream-side rear row so as to penetrate the fins and project sideways from the outermost ones of the fins, the U-bend portions being provided on the outermost ones of the fins to connect end portions of adjacent ones of the heat exchange pipes, the passageways guiding a heat exchange medium from the upstream side for subjecting the heat exchange medium to heat exchange with the heat exchange air, guiding the heat exchange medium from the upstream side to the downstream side at the bent portion, and then guiding the heat exchange medium again to the upstream side; and a flow introducing unit, provided on the upstream side, for introducing the heat exchange medium into the passageways and a flow discharging unit, provided on the downstream side, for discharging the heat exchange medium from the passageways.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1A to 3 relate to an embodiment of the present invention, in which FIG. 1A shows a refrigerating cycle circuit of an air-conditioner;

FIG. 2 is a vertical cross-sectional view of an indoor unit;

FIG. 3 is a side view of a heat exchanger;

DETAILED DESCRIPTION OF THE PREFERRED EMBODIMENTS

An embodiment of the present invention will now be described with reference to the accompanying drawings.

Figure 1A:
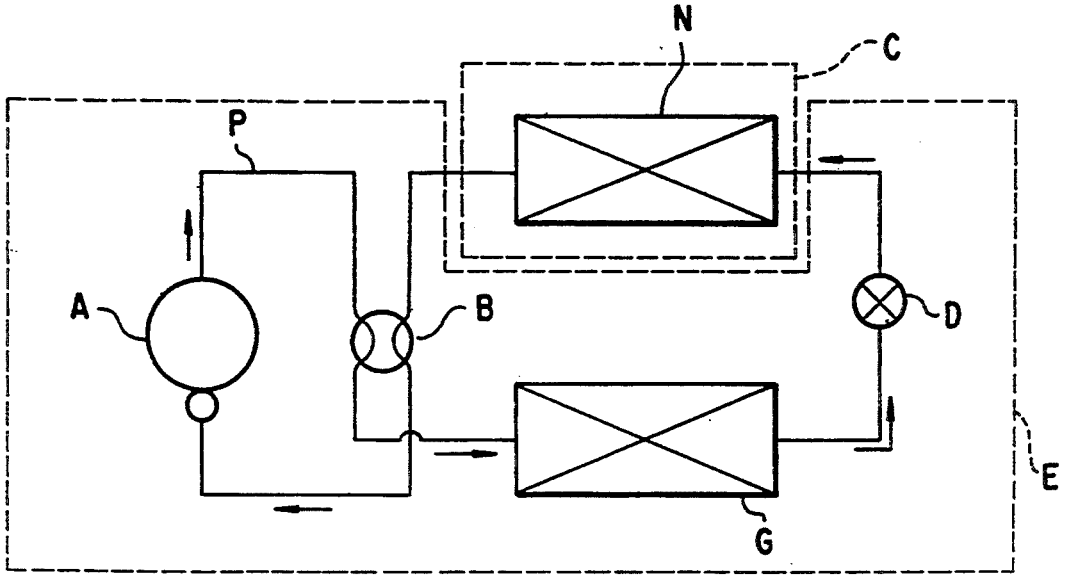

FIG. 1A shows a refrigerating cycle circuit of an air-conditioner.

A heat-pump type refrigerating cycle is constituted by a compressor A, a four-way valve B, an indoor heat exchanger N, an expansion device D and an outdoor heat exchanger G, which are connected via refrigerant pipes P.

The indoor heat exchanger N is situated in an indoor unit C, and the other parts are provided in an outdoor unit E.

A refrigerant is compressed by the compressor A and discharged in a high-temperature, high-pressure state. In the cooling mode, the refrigerant flows through the four-way valve B, outdoor heat exchanger G, expansion valve D, indoor heat exchanger N, four-way valve B and compressor A, in this order, as indicated by arrows in FIG. 1A.

In the indoor heat exchanger N, the refrigerant evaporates and latent heat of evaporation is absorbed from the incoming heat exchange air. The air is thereby converted to cool air. That is, a cooling operation is performed.

In the heating mode, the four-way valve B is switched, and the refrigerant flows through the compressor A, four-way valve B, indoor heat exchanger N, expansion valve D, outdoor heat exchanger G, four-way valve B and compressor A, in this order.

In the indoor heat exchanger N, refrigerant is condensed and heat of condensation is released to the incoming heat exchange air. The air is thereby converted to warm air. That is, a heating operation is performed.

Figure 2:
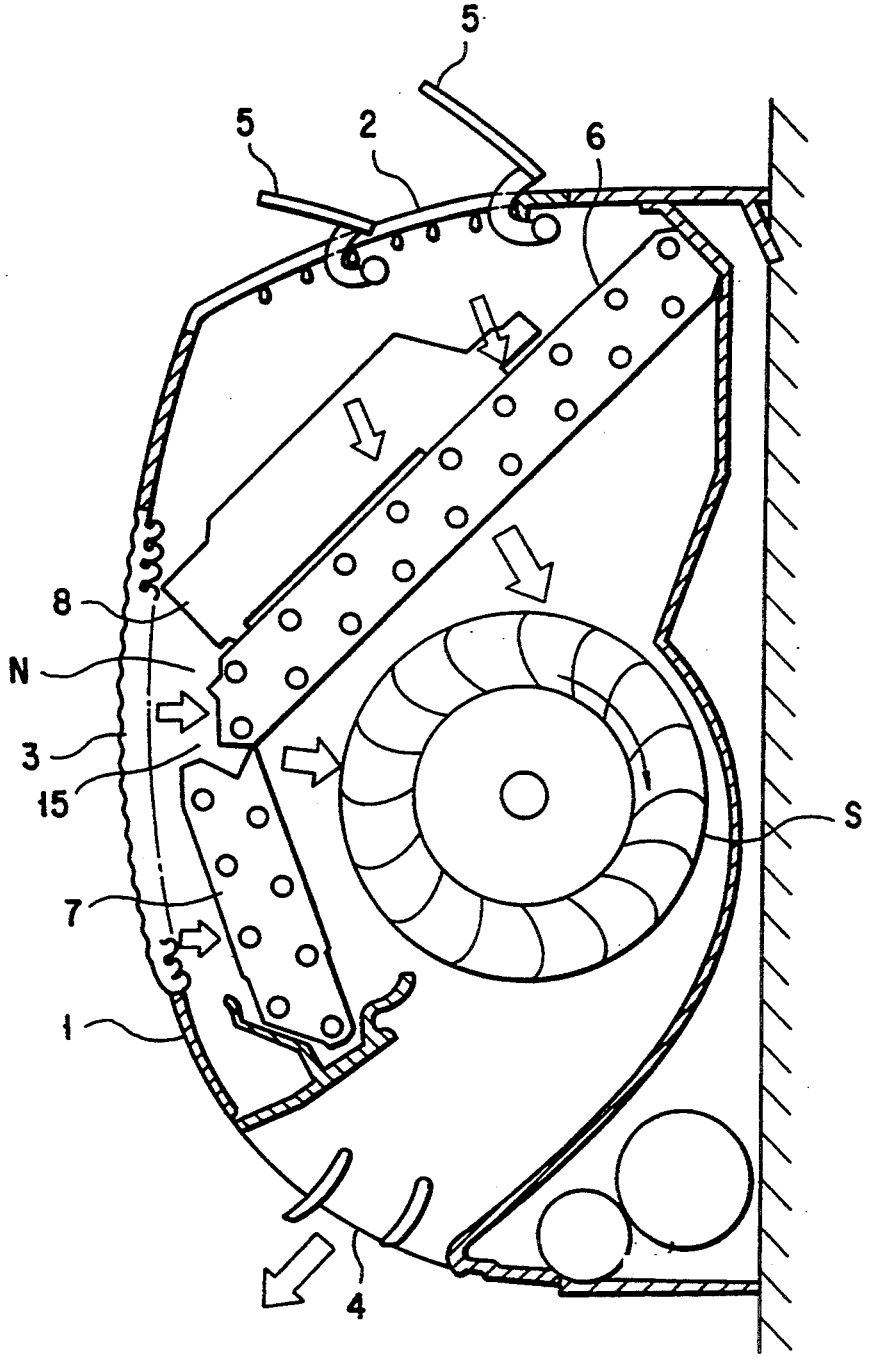

FIG. 2 shows a specific structure of the indoor unit C.

The bent-type indoor heat exchanger N is situated within a housing 1. An indoor air blower S is situated on the inside of the bent portion of the heat exchanger N.

An upper portion and a front portion of the housing 1 are provided with suction ports 2 and 3, respectively for taking in heat exchange air. A lower portion of the housing 1 is provided with a blowout port 4 for blowing heat exchange air.

A cover plate 5 is provided on the suction port 2 formed at the upper portion of the housing 1. The cover plate 5 is closed, for example, when the air conditioning operation is stopped.

The heat exchanger N is bent at a bent portion 15 and divided into an upper heat exchanger 6 and a lower heat exchanger 7.

An electric dust collector 8 is provided on the outer surface of the upper heat exchanger 6, which is opposed to the suction port 2. The dust collector 8 collects dust in the heat exchange air and cleans the air.

By driving the indoor air blower S, the heat exchange air is sucked from the suction port 2 and 3 into the housing 1, as indicated by the large arrows.

The outer surface of the bent-type heat exchanger N is situated on the upstream side of air. The heat exchange air passes through the heat exchanger and undergoes a heat exchange action. The inner surface of the heat exchanger N is situated on the downstream side of air, and the resultant heat exchange air goes past the inner surface of the heat exchanger N.

Further, the heat exchange air is blown from the blowout port 4 by means of the indoor air blower S.

Figure 3:
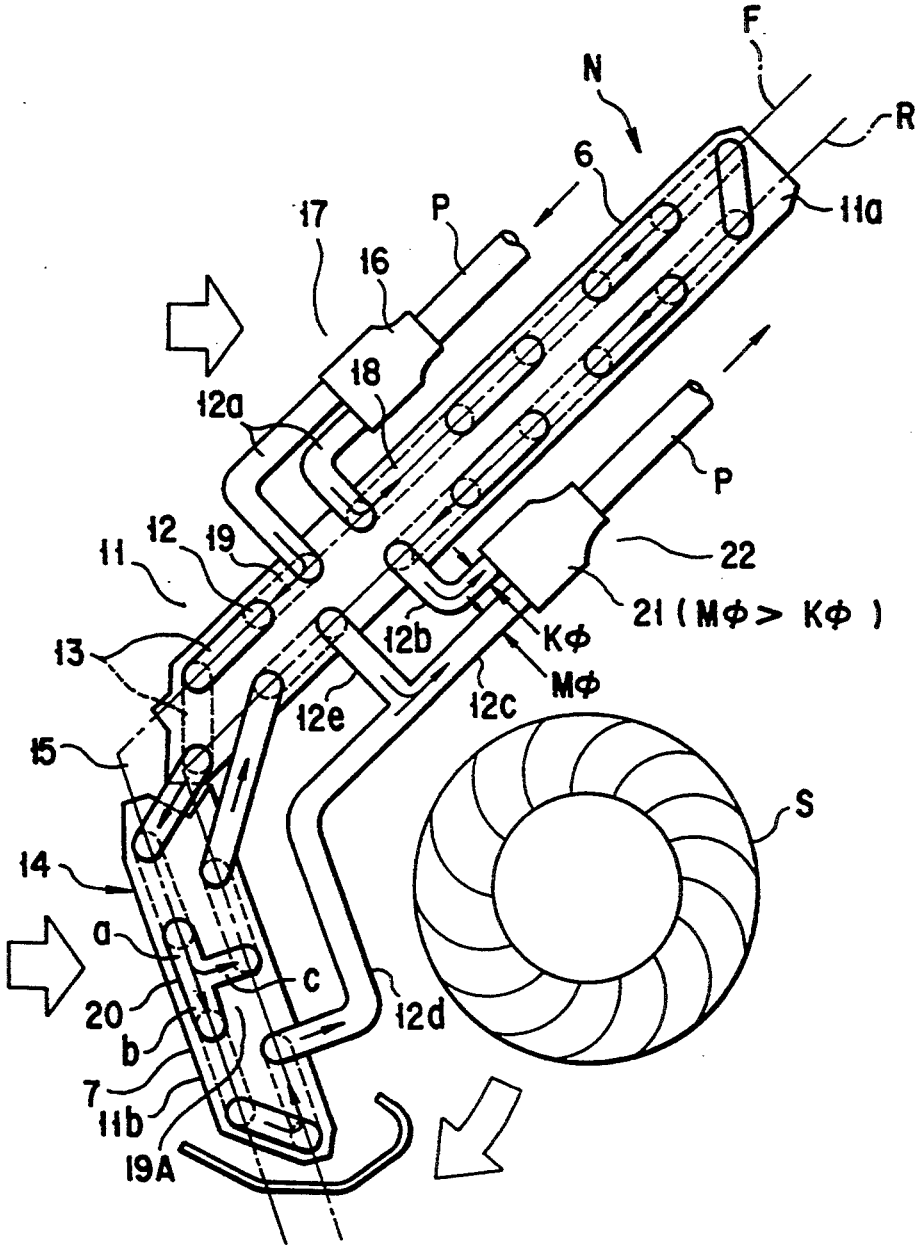
Figure 4:
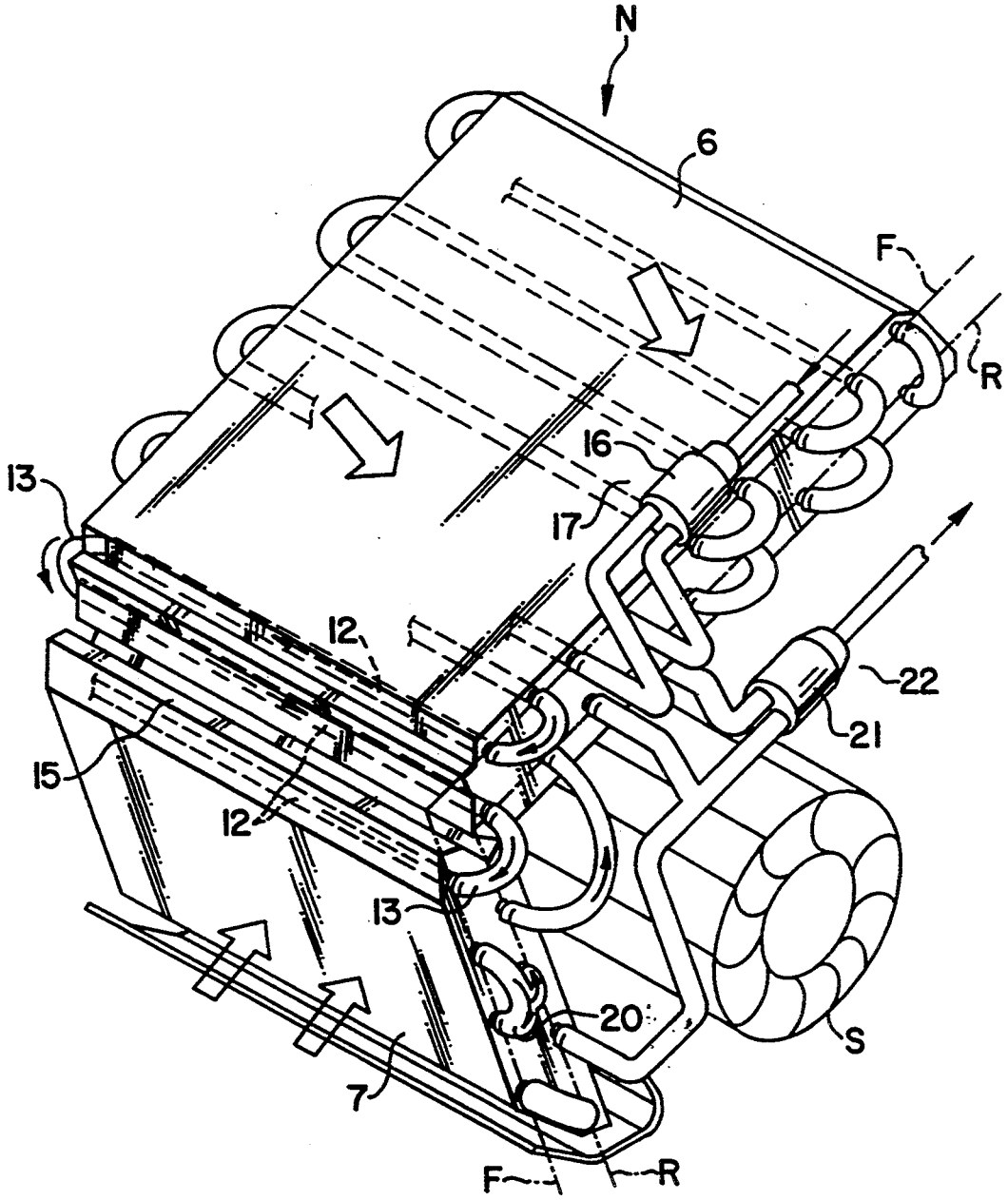
FIG. 4 is a perspective view of a heat exchanger.

As shown in FIGS. 3 and 4, the heat exchanger N comprises fins 11, heat exchange pipes 12, and U-bend portions 13 for connecting the end portions of the pipes 12.

Specifically, a number of fins 11 are juxtaposed in a direction perpendicular to the surface of the sheet of FIG. 3 at small intervals.

The heat exchange pipes 12 are straight pipes penetrating the fins in a direction perpendicular to the surface of the sheet of FIG. 3. Both end portions of the heat exchange pipes 12 project from the outermost fins 11.

The U-bend portions 13 connect end portions of the adjacent heat exchange pipes 12. Accordingly, the U-bend portions 13 are provided on both sides of the heat exchanger N.

The refrigerant or heat exchange medium flows through the heat exchange pipes 12 and U-bend portions 13 which constitute a flow passageway 14.

Figure 5:
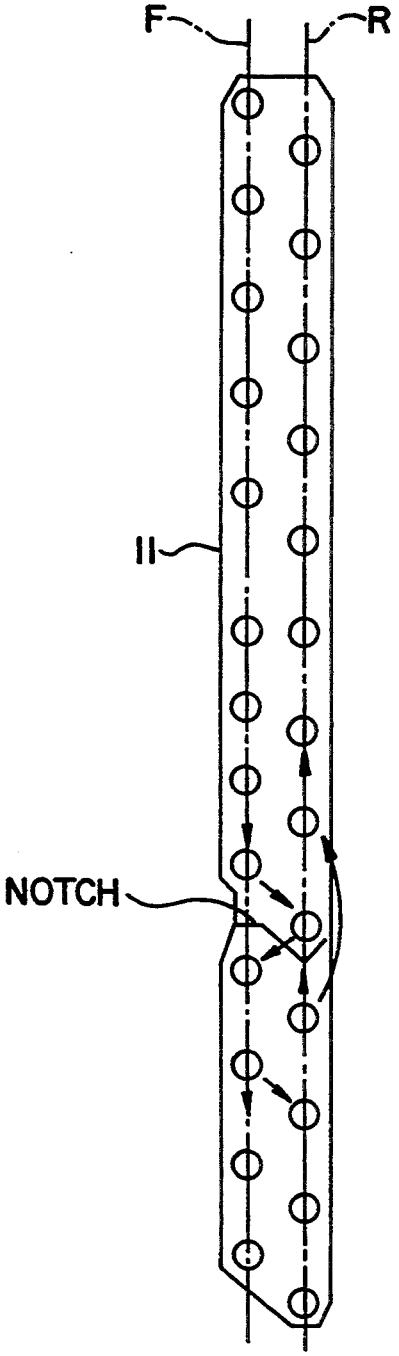
FIG. 5 shows a manufactured fin.

As shown in FIG. 5, each fin 11 is provided with a notch at which the fin 11 is bent.

The lower end face of the upper heat exchanger 6 and the upper end face of the lower heat exchanger 7 are opposed to each other at a bent portion 15 with a distance increasing gradually towards the upstream side of heat exchange air.

The heat exchange pipes 12 include a front-side (F) row of pipes and a rear-side (R) row of pipes which penetrate the fins 11.

The F-row of pipes 12 are situated on the upstream side, and the R-row of pipes 12 are on the downstream side.

A Y-joint 16 connected to a refrigerant pipe P is provided on the upstream side at the side part of the upper heat exchanger 6. The pipe P communicates with the outdoor unit E via the expansion valve D, as indicated in FIG. 1.

The output side of the Y-joint 16 is connected to two heat exchange pipes 12*a*, thus constituting a flow introducing unit 17 for dividing the incoming refrigerant from the refrigerant pipe P in two directions.

One of the heat exchange pipes 12*a* is connected to a first branch passageway 18 in the upper heat exchanger 6. The other heat exchange pipe 12*a* is connected to a second branch passageway 19 extending from the upper heat exchanger 6 to the lower heat exchanger 7 and again to the upper heat exchanger 6.

The first branch passageway 18 communicates via the heat exchange pipe 12*a* with the upper U-bend portions 13 and heat exchange pipes 12.

At the uppermost end of the upper heat exchanger 6, the first branch passageway 18 extends from the F-row side to the R-row side. The first branch passageway then communicates with the R-row side U-bend portions 13 and heat exchange pipes 12.

A heat exchange pipe 12*b* projecting to the side of the heat exchanger 6 and extending to the downstream side is connected to a substantially middle part of the R-row side portion.

The second branch passageway 19 communicates via the heat exchange pipe 12*a* with the lower U-bend portions 13 and heat exchange pipes 12.

At the lowermost end of the upper heat exchanger 6 the second branch passageway 19 extends from the F-row side to the R-row side along the bent portion 15. From the lowermost end of the R-row side of the upper heat exchanger 6, the passageway 19 extends to the uppermost end of the lower heat exchanger 7 on the F-row side. At this area, the passageway 19 bridges the upper and lower heat exchangers 6 and 7.

The second branch passageway 19 in the lower heat exchanger 7 is provided with a three-way bend portion 20 having an inlet a communicating with the upper F-row side and two outlets b and c communicating respectively with the lower F-row side and R-row side. Inlet a and outlet c are arranged at 90° angles to each other; outlets b and c are also arranged at 90° angles to each other.

One of the outlets, b, communicates with the lower F-row side U-bend portions 13 and heat exchange pipes 12.

The passageway from the outlet b extends from the lowermost end of the F-row of the lower heat exchanger 7 side to the lowermost end of the R-row side and communicates with the upper heat exchange pipes 12 and U-bend portions 13.

An end portion of the passageway from the outlet b is connected to an intermediate heat exchange pipe 12*d* projecting from the side of the heat exchanger 7 and extending to the downstream side.

The other outlet c communicates with the upper R-row heat exchange pipes 12 and U-bend portions 13.

At the uppermost end of the heat exchanger 7, the U-bend portion 13 connects the heat exchanger pipe 12 of the uppermost end of the heat exchanger 7 to the heat exchange pipe 12 of the R-row lowermost end of the upper heat exchanger 6. At this area, the passageway bridges the upper and lower heat exchangers 6 and 7.

Further, in the upper heat exchanger 6, the passageway communicates with the R-row upper heat exchange pipes 12 and U-bend portion 13.

At the position adjacent to the heat exchange pipe 12*b* where the first branch passageway 18 terminates, the passageway from the outlet c is connected to an intermediate heat exchange pipe 12*e* projecting to the side of the heat exchanger 6 and extending to the downstream side.

The intermediate heat exchange pipe 12*e* joins the intermediate heat exchange pipe 12*d* and communicates with a confluence heat exchange pipe 12*c*.

Thus, the second branch passageway 19 is provided with an intermediate passageway portion 19A extending from the three-way bend portion 20 for branching the refrigerant in two directions to the confluence portion of intermediate heat exchange pipes 12*d* and 12*e*.

The heat exchange pipe 12*b* at which the first branch passageway 18 terminates and the confluence heat exchange pipe 12*c* at which the second passageway 19 terminates are connected to a Y-joint 21 situated on the side of the upper heat exchanger 6 and on the downstream side.

The Y-joint 21 is connected to the refrigerant pipe P communicating with the four-way valve B, thereby constituting a flow discharging unit 22.

The diameter $M\phi$ of the confluence heat exchange pipe 12*c*, at which the second branch passageway 19 terminates, must be greater than the diameter $K\phi$ of the heat exchange pipe 12*b*, at which the first passageway 18 terminates ($M\phi > K\phi$).

Figure 1B:
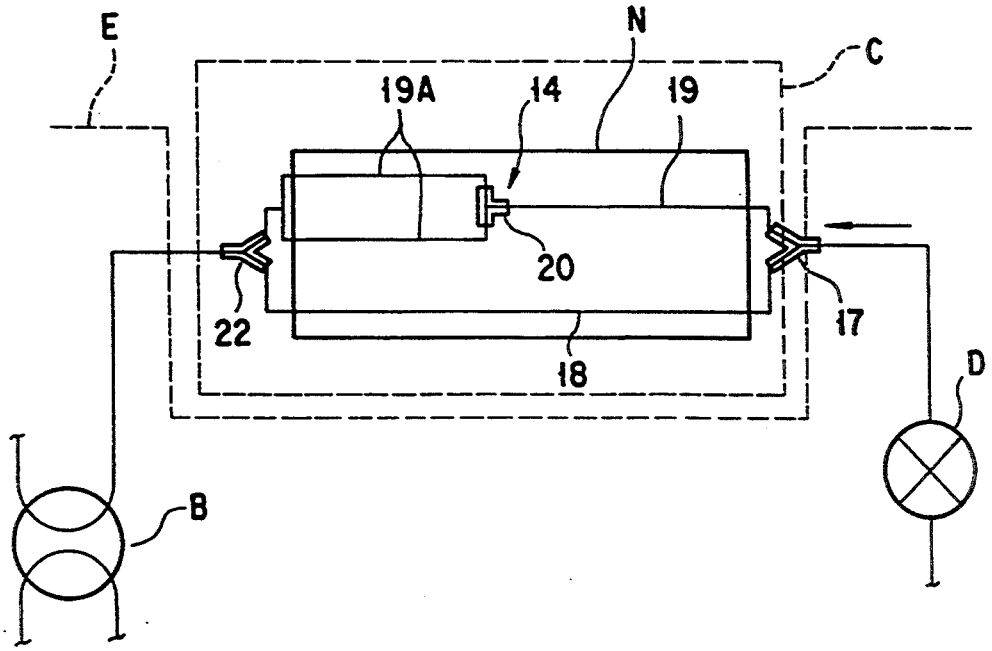
FIG. 1B shows a flow passageway structure in an indoor heat exchanger.

FIG. 1B schematically shows the structure of the passageway 14 in the indoor heat exchanger N.

In the indoor heat exchanger N having the above-described structure, when the heat exchanger N is operated in the cooling mode, the refrigerant coming from the outdoor unit E exchanges heat with the heat exchange air while it is let to flow from the refrigerant introducing unit 17 to the first and second branch passageways 18 and 19, thereby changing the heat exchange air to cool air.

The flow of the refrigerant in the passageway 14 in the heat exchanger N will now be described in greater detail.

The refrigerant supplied from the Y-joint 16 of the flow introducing unit 17 to the first branch passageway 18 is guided upwards from the F-row side to the R-row side at the uppermost end.

Then, the refrigerant goes downwards from the R-row uppermost end and flows out of the upper heat exchanger 6 via the heat exchange pipe 12*b*. Then, the refrigerant joins the refrigerant guided through the second branch passageway 19 at the Y-joint 21.

The refrigerant supplied from the Y-joint 16 to the second passageway 19 flows downwards on the F-row side. At the lowermost end of the upper heat exchanger 6, it flows along the bent portion 15 into the lower heat exchanger 7.

Further, at the three-way bend portion 20, the refrigerant is branched in two directions.

The refrigerant flowing out of one of the outlets, b, flows straight downwards. At the lowermost end, it flows to the R-row lowermost end and then flows upwards.

The refrigerant flows out of the lower heat exchanger 7 via the intermediate heat exchange pipe **12*d*** and joins the refrigerant flowing from the other outlet c.

The refrigerant flowing out of the side outlet c goes upwards on the R-row side and is guided midway to the R-row side of the upper heat exchanger 6 via the U-bend portion 13 bridging the upper and lower heat exchangers 6 and 7.

The refrigerant then flows out of the upper heat exchanger 6 via the intermediate heat exchange pipe **12*e*** and joins the refrigerant flowing from the other outlet b.

The confluence refrigerant flowing from the outlets b and c is guided through the confluence heat exchange pipe **12*c* and joins the refrigerant of the first branch passageway 18 at the Y-joint 21**.

The flow of refrigerant has been described above. In particular, in the cooling mode under the conditions of high humidity, even if humid air flows in the vicinity of the bent portion 15 or space portion, humidity can be sufficiently removed and no dew condensation occurs on peripheral parts or inner walls of the housing 1.

That is, a liquid refrigerant comes from the flow introducing unit 17 and evaporates while flowing through the passageways 18 and 19, and a gas/liquid two-phase refrigerant changes to evaporated refrigerant.

In particular, in the vicinity of the bent portion 15 of the second passageway 19, the refrigerant becomes a gas/liquid two-phase refrigerant at a gas/liquid ratio which is advantageous for removing humidity.

The passageway 19 extends from the F-row lowermost end to the R-row lowermost end of the upper heat exchanger 6 and further to the F-row side of the lower heat exchanger 7. Furthermore, the passage 19 has a passageway portion bridging the R-row uppermost end of the lower heat exchanger 7 to the R-row lowermost end of the upper heat exchanger 6.

Since the passageway is designed in this manner at the bent portion 15 and the gas/liquid two-phase refrigerant is let to flow, humidity is sufficiently removed from incoming heat exchange air and dew condensation is prevented from occurring on peripheral parts or inner walls of the housing 1.

Besides, at the intermediate passageway portion 19A of the second branch passageway 19, the three-way bend portion 20 is provided to receive the refrigerant from the upper-side inlet a and branch it to the downward outlet b and the outlet c in a direction perpendicular to the direction of the outlet b.

At the position where the three-way bend portion 20 is provided, the gas/liquid two-phase refrigerant flows and there is a difference in specific gravity between the gas-phase refrigerant portion and liquid-phase refrigerant portion.

If such refrigerant is introduced into the three-way bend portion 20, equal amounts of refrigerants flow to the downward outlet and to the side outlet.

As a result, the amount of circulated refrigerant increases in the second branch passageway 19, and the heat exchange efficiency is enhanced.

In the above embodiment, the heat exchanger N itself is of the bent-type and the small-diameter heat exchange pipe 12 is used. However, the refrigerant can be let to flow uniformly and smoothly in the heat exchanger N by virtue of the above-described structure of the first and second branch passageways.

Therefore, a great amount of circulated refrigerant is ensured and the heat exchange efficiency is enhanced.

In addition, since the diameter M$\phi$ of the confluence heat exchange pipe **12*c* of the second branch passageway 19 is made greater than the diameter K$\phi$ of the heat exchange pipe 12*b* of the first passageway 18**, substantially three refrigerant output sections are provided. Therefore, pressure loss is decreased, and uniform refrigerant output amounts can be attained.

Additional advantages and modifications will readily occur to those skilled in the art. Therefore, the invention in its broader aspects is not limited to the specific details and representative devices shown and described herein. Accordingly, various modifications may be made without departing from the spirit or scope of the general inventive concept as defined by the appended claims and their equivalents.

What is claimed is:

1. A heat exchanger having in fins flow passageways constituted by heat exchange pipes and U-bend portions, comprising:

fins juxtaposed at narrow intervals, one side of said fins serving as an upstream side for receiving heat exchange air, the other side of said fins serving as a downstream side for outputting the heat exchange air;

a bent portion provided at a substantially middle portion of said fins in the longitudinal direction of said fins, said fins being bent at said bent portion in the direction of conduction of the heat exchange air;

passageways constituted by heat exchange pipes and U-bend portions, said heat exchange pipes being arranged in an upstream-side front row and a downstream-side rear row so as to penetrate said fins and project sideways from the outermost ones of said fins, said U-bend portions being provided on said outermost ones of said fins to connect end portions of adjacent ones of said heat exchange pipes, said passageways guiding a heat exchange medium from the upstream side for subjecting the heat exchange medium to heat exchange with the heat exchange air, guiding the heat exchange medium from the upstream side to the downstream side at said bent portion, and then guiding the heat exchange medium again to the upstream side; and a flow introducing unit, provided on the upstream side, for introducing the heat exchange medium into the passageways and a flow discharging unit, provided on the downstream side, for discharging the heat exchange medium from said passageways.

2. The heat exchanger according to claim 1, wherein an upper heat exchanger is constituted by upper portions of the fins, the head exchange pipes situated above the bent portion, and the U-bend portions situated above the bent portion, and a lower heat exchanger is constituted by lower portions of the fins, the heat exchange pipes situated below the bent portion, and the U-bend portions situated below the bent portion, and wherein said bent portion is a space portion at which the distance between the lower end face of the upper heat exchanger and the upper end face of the lower heat exchanger increases gradually towards the upstream side of the heat exchange air.

3. The heat exchanger according to claim 1, wherein said passageways are divided into a first branch passageway and a second branch passageway from said flow introducing unit, and said first and second branch passageways join each other at the flow discharging unit.

4. The heat exchanger according to claim 3, wherein said first branch passageway is provided only on the upper heat exchanger, and said second branch passageway extends from said upper heat exchanger to the lower heat exchanger via said bent portion and further extends from the lower heat exchanger to the upper heat exchanger via said bent portion.

5. The heat exchanger according to claim 3, wherein said first branch passageway introduces the heat exchange medium from the front-row side heat exchange pipe, supplies the heat exchange medium successively to the U-bend portions and the heat exchange pipes and discharges the heat exchange medium from the rear-row side heat exchange pipe, and said second branch passageway introduces the heat exchange medium from the front-row side heat exchange pipe, supplies the heat exchange medium successively to the U-bend portions and the heat exchange pipes, guiding the heat exchange medium from the front-row side heat exchange pipe to the rear-row side heat exchange pipe via the U-bend portion, guiding the heat exchange medium again to the front-row side heat exchange pipe via the U-bend portion, and finally discharges the heat exchange medium from the rear-row side heat exchange pipe.

6. The heat exchanger according to claim 4, wherein a middle portion of the second branch passageway in the lower heat exchanger is provided with a three-way bend portion having an inlet communicating with the upper front-row side and two outlets communicating respectively with the lower front-row side and rear-row lateral side, said the inlet and outlets being arranged at 90° with each other.

7. The heat exchanger according to claim 6, wherein said second branch passageway is provided with an intermediate passageway portion for branching the heat exchange medium in two directions by means of said three-way bend portion and then joining the branched flows of the heat exchange medium.

8. The heat exchanger according to claim 6, wherein the heat exchange medium supplied to the lower front-row side is guided from one of the outlets of the three-way bend portion to a confluence pipe via the lower heat exchanger, the heat exchange medium supplied to the rear-row lateral side from the other outlet of the three-way bend portion is guided from the lower heat exchanger to the upper heat exchanger and to the confluence pipe, and both heat exchange mediums are joined in the confluence pipe.

9. The heat exchanger according to claim 6, wherein the diameter of said confluence pipe is greater than that of the heat exchange pipe of the first branch passageway connected to the flow discharging unit.

10. The heat exchanger according to claim 1, wherein said flow introducing unit is connected to an outdoor heat exchanger via an expansion valve which is a component of a heat-pump type refrigerating cycle, the flow discharging unit is connected to a compressor via a four-way valve, and a refrigerant functioning as the heat exchange medium is guided through said passageways.

* * * * *